US005288258A

United States Patent [19]

Soso

[11] Patent Number: 5,288,258

[45] Date of Patent: Feb. 22, 1994

[54] WHEELED TOY

[76] Inventor: Owen R. Soso, 12407 Atlantic Ave., #16, Lynwood, Calif. 90262

[21] Appl. No.: 856,562

[22] Filed: Mar. 23, 1992

[51] Int. Cl.[5] ..... A63H 33/40; A63H 33/02

[52] U.S. Cl. ..... 446/218; 446/451

[58] Field of Search ..... 446/451, 411, 412, 468, 446/238, 237, 217, 218

[56] References Cited

U.S. PATENT DOCUMENTS

| | | | |
|---|---|---|---|
| 327,577 | 10/1885 | Myers | 446/238 |
| 1,583,567 | 5/1926 | Becker | 446/237 |
| 1,867,052 | 7/1932 | Bergstrand | 446/411 X |
| 4,016,675 | 4/1977 | Drucker | 446/451 |

*Primary Examiner*—Mickey Yu

*Attorney, Agent, or Firm*—S. Michael Bender

[57] ABSTRACT

A wheeled toy utilizes a pair of wheels mounted on an axle and moveable by an attached broom handle. A wire support straddles the two wheels, fitting over the outer ends of the axle, and a string assembly attached to the wire support facilitates a turning of the wheels relative to the handle. A fan spindle is rotatably attached to a plastic ball centered between the wheels, and a length of cord may be utilized to spin a plurality of radially mounted balls on the spindle. Alternatively, fan blades of various configurations can be used to rotate the spindle. The fan assembly includes colored rubber balls which orbit around the spindle, and one of the embodiments of the invention includes removable air scoops attachable to one or more balls so as to effectively operate as fan blades.

1 Claim, 4 Drawing Sheets

WHEELED TOY

BACKGROUND OF THE INVENTION

1. Field of the Invention

The present invention relates to wheeled toys, and more particularly pertains to a wheeled toy which is pulled or pushed by a handle and which includes a rotatable fan structure.

2. Description of the Prior Art

There is an unending need for action toys which will please children. In this respect, children love to pull carts which cause marvelous things to happen, especially wherein fans or similar devices rotate when the cart is pulled. As such, the present invention is directed to fulfilling this continuing interest for new and different toys.

SUMMARY OF THE INVENTION

In view of the foregoing disadvantages inherent in the known types of wheeled toys now present in the prior art, the present invention provides an improved wheeled toy construction wherein the same can be moved along a ground surface by a handle and wherein manually or operable fan blades facilitate the orbital movement of a plurality of gaily colored balls. As such, the general purpose of the present invention, which will be described subsequently in greater detail, is to provide a new and improved wheeled toy apparatus and method which has all the advantages of the prior art wheeled toys and none of the disadvantages.

To attain this, the present invention essentially comprises a wheeled toy which utilizes a pair of wheels mounted on an axle and moveable by an attached broom handle. A wire support straddles the two wheels, fitting over the outer ends of the axle, and a string assembly attached to the wire support facilitates a turning of the wheels relative to the handle. A fan spindle is rotatably attached to a plastic ball centered between the wheels, and a length of cord may be utilized to spin a plurality of radially mounted balls on the spindle. Alternatively, fan blades of various configurations can be used to rotate the spindle. The fan assembly includes colored rubber balls which orbit around the spindle, and one of the embodiments of the invention includes removable air scoops attachable to one or more balls so as to effectively operate as fan blades.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved wheeled toy which has all the advantages of the prior art wheeled toys and none of the disadvantages.

It is another object of the present invention to provide a new and improved wheeled toy which may be easily and efficiently manufactured and marketed.

It is a further object of the present invention to provide a new and improved wheeled toy which is of a durable and reliable construction.

An even further object of the present invention is to provide a new and improved wheeled toy which is susceptible of a low cost of manufacture with regard to both materials and labor, and which accordingly is then susceptible of low prices of sale to the consuming public, thereby making such wheeled toys economically available to the buying public.

Still yet another object of the present invention is to provide a new and improved wheeled toy which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENTS

Figure 1:
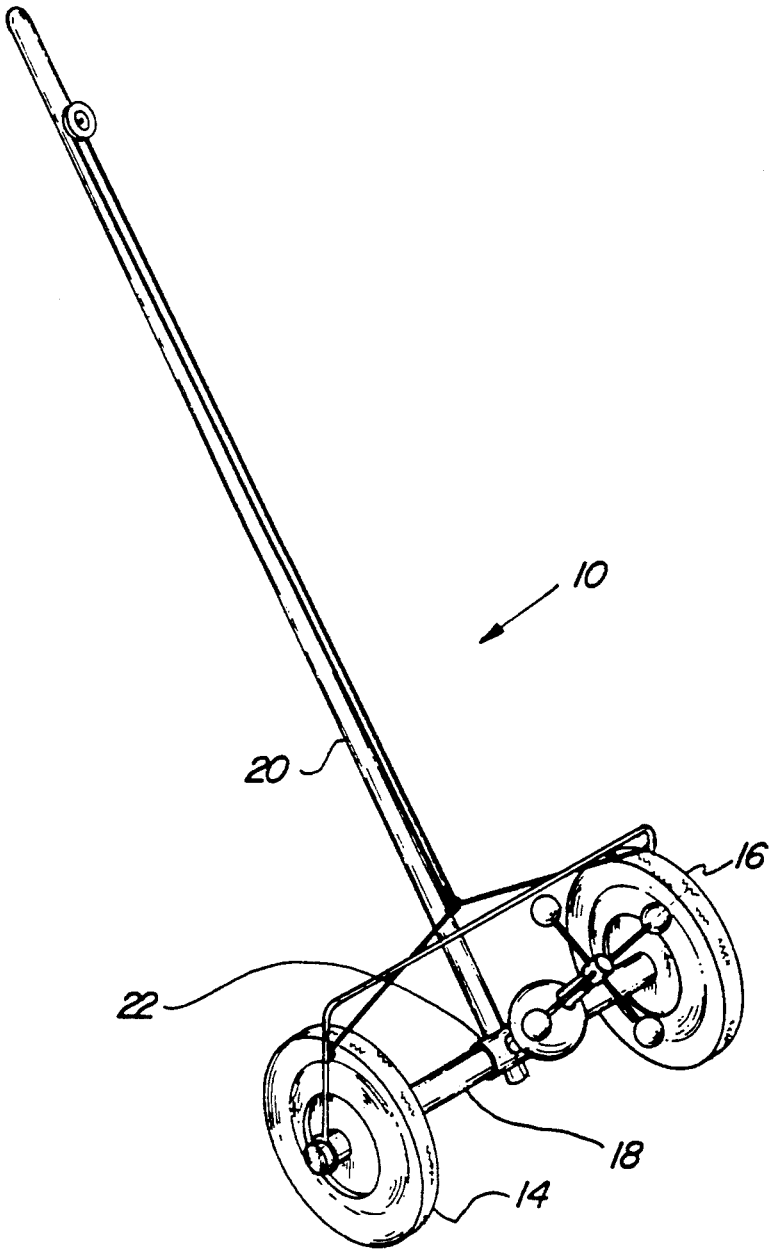
FIG. 1 is a perspective view of the wheeled toy comprising the present invention.
Figure 2:
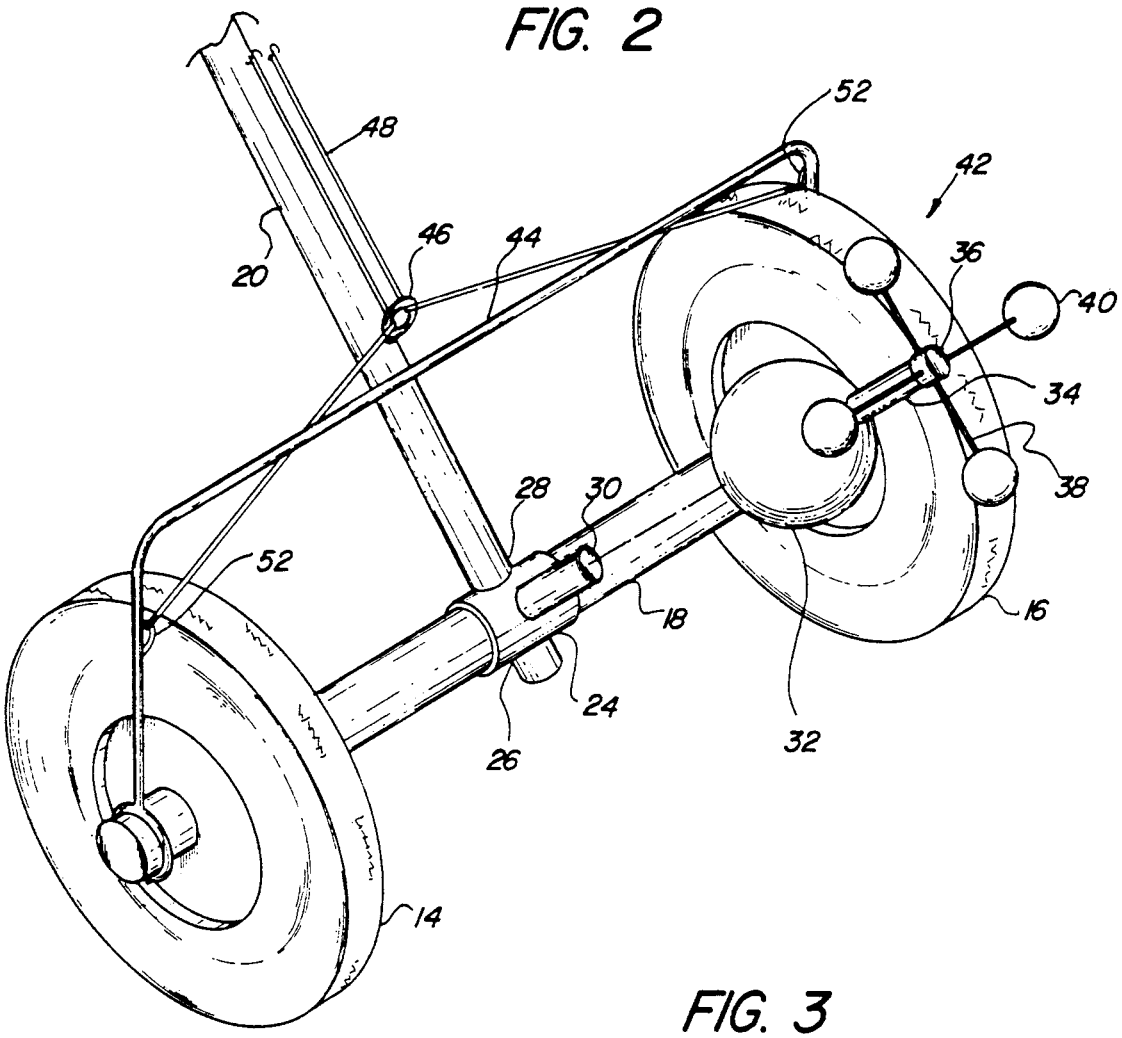
FIG. 2 is an enlarged perspective view of a portion of the invention.
Figure 3:
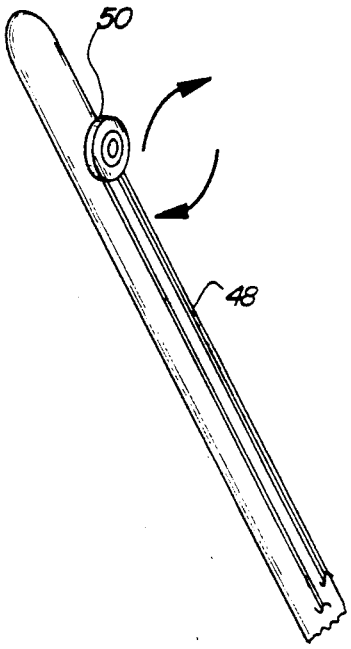
FIG. 3 is an enlarged perspective view of another portion of the invention.

With reference now to the drawings, and in particular to FIGS. 1–3 thereof, a new and improved wheeled toy embodying the principles and concepts of the present invention and generally designated by the reference numeral 10 will be described.

More specifically, it will be noted that the toy 10 includes two rubber or plastic tired wheels 14, 16 which are rotatably mounted on opposed ends of an axle 18. A broom handle 20 extends through a central opening 22 in the axle 18 and is rotatably mounted therein by some conventional means. In this regard, the axle 18 could be split apart in a central portion thereof and joined by a tubular coupling 24 as best illustrated in FIG. 2. The coupling 24 could be provided with top and bottom aligned apertures 26, 28 through which the handle 20 may be rotatably mounted. A pin could be inserted through handle 20 interiorly of the coupling 24 so as to be in a non-dangerous position to a child, whereby this pin would effectively retain the handle 20 rotatably mounted within the coupling 24 in a now apparent manner.

Extending upwardly from the coupling 24 is a fixedly secured post 30 over which a colorful, lightweight ball 32 may be slidably, rotatably positioned. In this regard, the ball 32 would have a bottom opening to allow its positioning over the post 30, and its hollow lightweight structure would allow it to freely rotate around the post.

Fixedly secured to a top portion of the ball 32 is an upstanding post 34 having a top mounted cap 36 from which are mounted a plurality of radially extending arms, each of these arms being generally designated by the reference numeral 38. Attached to remote ends of the radially extending arms 38 are a plurality of colorful lightweight rubber or plastic balls, each of these balls being generally designated by the reference numeral 40. In the preferred embodiment 10 of the invention, an unillustrated length of twine could be wrapped around the post 34 and upon a pulling of the twine, a spinning motion would be imparted to the ball 32 and its attached fan structure 42, wherein such fan structure effectively consists of the post 34, the radially extending arms 38 and the colorful balls 40 attached to the ends of these arms. Periodically, the length of twine could be rewound around the post 34 so that a child could again yank the twine and impart a renewed orbital movement of the balls 40.

With continuing reference to FIG. 2 of the drawings it can bee seen that a U-shaped wire structure 44 is positioned over the wheels 14, 16 and fixedly secured to the ends of the axle 18 by some conventional means. An eye 46 is secured in the handle 20 whereby a continuous length of twine 48 is directed up to and over a rotatable knob 50 mounted on a top portion of the handle as best illustrated in FIG. 3. The twine 48 is looped around the knob 50 for a plurality of turns with the free ends of the twine being attached through rigid wire loops 52 forming a part of the respective opposed legs on the wire member 44. As is apparent, a selective rotation of the knob 50 will effectively cause the twine to pull the wire support member 44 in one direction or the other, thereby to effectively apply a torque to axle 18 causing it to rotate relative to handle 20 and thereby redirect the wheel direction of the wheeled toy 10.

Figure 4:
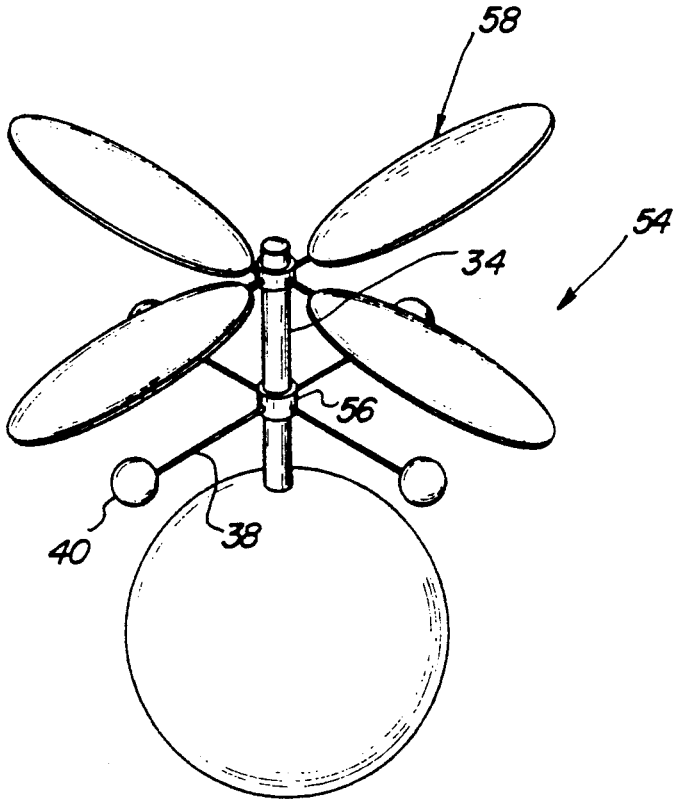
FIG. 4 is a perspective view of a modified embodiment of the fan assembly comprising a part of the present invention.

FIG. 4 of the drawings illustrates a modified embodiment of the fan structure comprising the present invention wherein such modified embodiment is generally designated by the reference numeral 54. In this embodiment, the cap member 36 has been replaced with a coupling 56 which allows the radially extending arms 38 and their attached balls 40 to be slid down the post 34. Appropriate attachment means can be utilized to secure the coupling 56 in a desired location, and a fan blade arrangement 58 can then be attached to a topmost portion of the post 34. The fan blade arrangement 58 effects a rotatable movement of the entire fan assembly 54 when the wheeled toy 10 is moved along a ground surface due to a movement of air across the fan blades.

Figure 5:
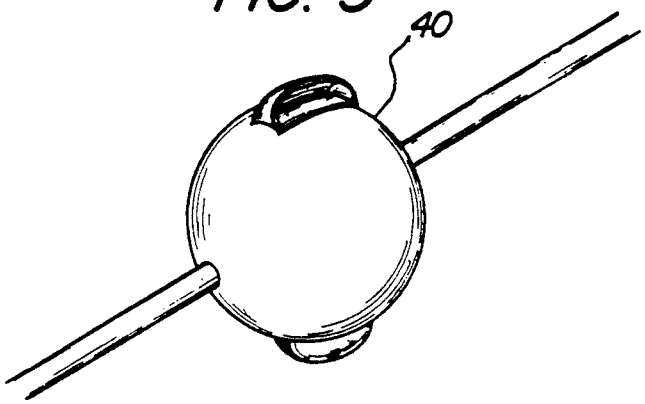
FIG. 5 is a perspective view of a modified ball forming a part of the present invention.
Figure 6:
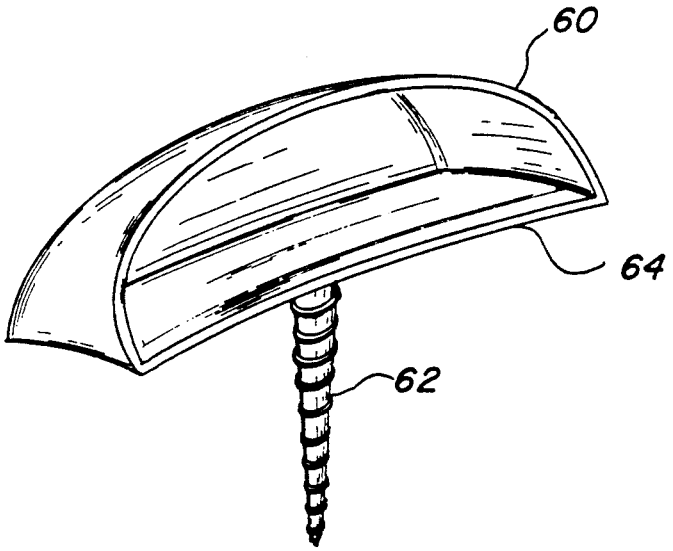
FIG. 6 is a perspective view of an air scoop attachable to the ball shown in FIG. 5.
Figure 7:
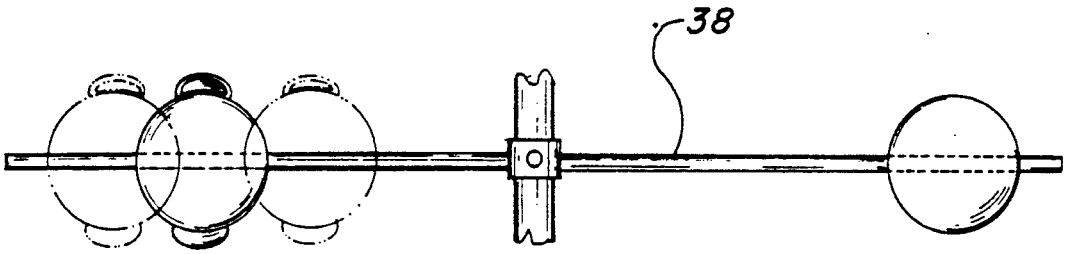
FIG. 7 is an elevation view illustrating an adjustable fan assembly.

FIGS. 5 and 6 illustrate a modified fan arrangement which can be utilized in conjunction with or without the fan blade structure 58. In this regard, a small air scoop 60 formed of a lightweight material has a fixedly secured downwardly extending screw member which allows the air scoop to be threadably attached to a rubber or plastic ball 40 as best illustrated in FIG. 5. The air scoop 60 has a concavely shaped bottom wall section 64 which allows it to conform to the outer circumference of the ball 40 and the scoops can be selectively positioned in any direction so as to capture the wind during a movement of the toy 10. The scoops 60 facilitate a rotative movement of the fan assembly 54 with or without the use of the fan blade structure 58. In the event that the scoops 60 are utilized in a non-symmetrical manner on the balls 40, it can be seen that the balls 40 can be selectively slid along the radially extending arms 38 so as to achieve a proper weight balance. Such a weight balance is important if the fan assembly 54 is to rotate in a unencumbered and efficient manner.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved wheeled toy comprising:

wheel and axle means for moving said toy along a ground surface;

handle means rotatably attached to said wheel and axle means;

steering means for facilitating a change of direction between said wheel and axle means and said handle means;

and fan assembly means rotatably attached to said wheel and axle means;

wherein said steering means includes a wire support structure attached to said wheel and axle means and further includes flexible cord means attached between said wire support structure and a top end of said handle means, said flexible cord means having opposite ends thereof being attached to opposed sides of said wire support structure and further having a central continuous portion thereof looped around a rotatable knob attached to said top portion of said handle means, whereby a rotation of said knob effects a rotatable movement of said wire support structure relative to said handle means, thereby to change a relative direction between said wheel and axle means and said handle means, and further wherein said fan assembly means includes a rotatable ball mounted to a central portion of said wheel and axle means, said rotatable ball including an upstanding post to which a plurality of radially extending arms are fixedly secured, said radially extending arms having balls attached to end thereof, and further including a fan blade structure attachable to said upstanding arm, and at least one removable air scoop attachable to at least one of said balls fixedly secured to ends of said radially extending arms.

* * * * *